US011552428B2

(12) United States Patent
Goodfellow et al.

(10) Patent No.: US 11,552,428 B2
(45) Date of Patent: Jan. 10, 2023

(54) SYSTEMS AND METHODS FOR A CABLE CLIP

(71) Applicant: Juggernaut Defense, LLC, Scottsdale, AZ (US)

(72) Inventors: Andrew Goodfellow, Scottsdale, AZ (US); Thomas Muday, Scottsdale, AZ (US)

(73) Assignee: Juggernaut Defense, LLC, Scottsdale, AZ (US)

( * ) Notice: Subject to any disclaimer, the term of this patent is extended or adjusted under 35 U.S.C. 154(b) by 176 days.

(21) Appl. No.: 16/800,506

(22) Filed: Feb. 25, 2020

(65) Prior Publication Data

US 2020/0274292 A1 Aug. 27, 2020

Related U.S. Application Data

(60) Provisional application No. 62/810,019, filed on Feb. 25, 2019.

(51) Int. Cl.
*H01R 13/627* (2006.01)
*H01R 13/52* (2006.01)

(52) U.S. Cl.
CPC ..... *H01R 13/6273* (2013.01); *H01R 13/5219* (2013.01)

(58) Field of Classification Search
CPC ..... H01R 13/40–13/6599; H01R 13/6275; H01R 13/6273; H01R 13/2421; H01R 13/6205; H01R 13/629; H01R 2107/00; H01R 31/06; H01R 13/512; H01R 13/518; H01R 13/5219; H01R 13/56; H01R 13/5808; H01R 13/621; H01R 13/6315; H01R 13/639; H01R 24/60; H01R 12/7023; H01R 12/7047; H01R 12/716; H01R 12/722; H01R 12/724; H01R 12/727; H01R 12/737; H01R 12/75; H01R 12/772; H01R 12/79; H01R 13/05; H01R 13/22; H01R 13/2407; H01R 13/28; H01R 13/432; H01R 13/506; H01R 13/516; H01R 13/5202; H01R 13/5841; H01R 13/5845; H01R 13/6215; H01R 13/627; H01R 13/6272; H01R 13/6278; H01R 13/631; H01R 13/633; H01R 13/635; H01R 13/6485; H01R 13/652; H01R 13/6581; H01R 13/66; H01R 13/73; H01R 13/741; H01R 13/743; H01R 13/748; H01R 2103/00; H01R 2105/00; H01R 2201/16; H01R 2201/24;

(Continued)

(56) References Cited

U.S. PATENT DOCUMENTS 5,378,882 A * 1/1995 Gong ..... G06K 7/10881 439/314
5,383,794 A * 1/1995 Davis ..... H01R 13/516 439/352

(Continued)

OTHER PUBLICATIONS

International Search Report and Written Opinion issued in corresponding Application No. PCT/US2020/019686 dated May 22, 2020, 11 pages.

*Primary Examiner* — Oscar C Jimenez
(74) *Attorney, Agent, or Firm* — Polsinelli PC

(57) ABSTRACT

Various embodiments of a cable clip having a clip housing configured to engage a casing to establish an operative connection with a portable device encased within the casing are disclosed.

18 Claims, 10 Drawing Sheets

(58) Field of Classification Search
CPC ..... H01R 24/20; H01R 24/50; H01R 24/66; H01R 24/68; H01R 24/86; H01R 43/24; H01R 9/16
USPC ..... 439/358, 357, 353, 180, 939, 247, 341, 439/350, 352, 354, 495, 540.1, 557, 567, 439/578, 607.44, 810, 923
See application file for complete search history.

(56) References Cited

U.S. PATENT DOCUMENTS 5,898,789 A * 4/1999 Nichols ..... H01R 13/506 381/361
5,921,808 A 7/1999 Haftmann et al.
6,165,002 A * 12/2000 Kalis ..... H01R 13/6275 439/357
6,305,986 B1 * 10/2001 Hwang ..... H01R 13/6485 439/358
6,331,079 B1 12/2001 Grols et al.
6,361,218 B1 * 3/2002 Matasek ..... G02B 6/3821 385/60
6,375,487 B1 * 4/2002 Tennessen ..... H01R 13/5845 439/373
6,910,911 B2 * 6/2005 Mellott ..... H01R 13/2421 439/358
6,939,161 B1 * 9/2005 Yi ..... H01R 13/6395 439/373
7,399,208 B2 7/2008 Schmidt
7,442,060 B2 * 10/2008 Suwalski ..... H01R 13/6275 439/180
8,105,108 B2 1/2012 Vroom et al.
D703,671 S * 4/2014 Hackett ..... D14/433
8,911,246 B2 * 12/2014 Carnevali ..... G06F 1/1632 439/929
9,298,219 B2 * 3/2016 Gulick, Jr. ..... G06F 1/1632
9,831,603 B2 * 11/2017 Balest ..... H01R 33/97
10,361,507 B2 * 7/2019 Zaytoun, Jr. ..... H02J 7/0042
10,395,082 B1 * 8/2019 Thompson ..... G06K 7/10881
11,050,189 B1 * 6/2021 Garcia ..... H04B 1/3888
2006/0058073 A1 3/2006 Kim
2017/0227987 A1 8/2017 Carnevali et al.
2018/0115128 A1 4/2018 Choi et al.
2018/0241154 A1 8/2018 Khorrami et al.

* cited by examiner

SYSTEMS AND METHODS FOR A CABLE CLIP

CROSS-REFERENCE TO RELATED APPLICATIONS

This is a non-provisional application that claims benefit to U.S. provisional application Ser. No. 62/810,019 filed on Feb. 25, 2019 which is herein incorporated by reference in its entirety.

FIELD

The present disclosure generally relates to a cable clip; and in particular to a systems and methods for a cable clip used to operatively engage a cable to a portable device enclosed inside a protective casing.

BACKGROUND

Protective casings used to encase and protect a portable device are well known. Typically, cables used to transmit data and/or power to the portable device encased in the protective casing can easily become detached when jostled or jarred by an external impact or entanglement. As such, data and power transmission can be interrupted when the cable becomes detached from the protective casing, thereby leading to loss of power or incomplete data transmission to the portable device.

It is with these observations in mind, among others, that various aspects of the present disclosure were conceived and developed.

BRIEF DESCRIPTION OF THE DRAWINGS

Corresponding reference characters indicate corresponding elements among the view of the drawings. The headings used in the figures do not limit the scope of the claims.

DETAILED DESCRIPTION

Figure 1:
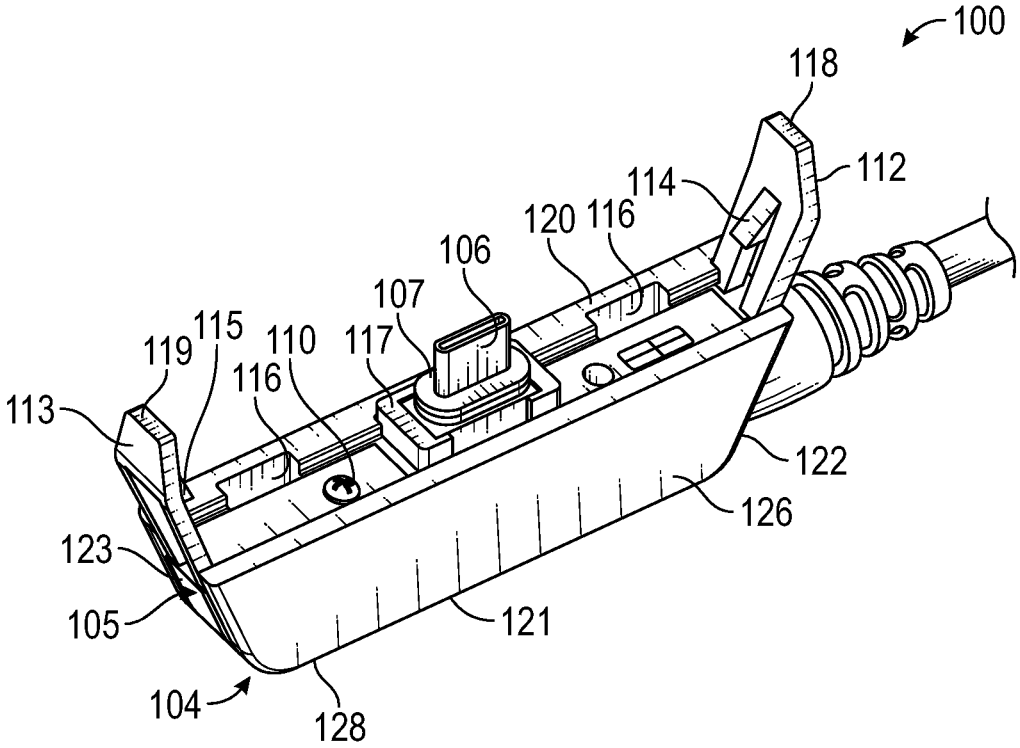
FIG. 1 is a perspective view of a cable clip engaged to a cable.

Various embodiments of a cable clip used to operatively engage a data cable having a USB connecter to a portable device encased in a protective casing are disclosed herein. In some embodiments, the cable clip includes a clip housing operatively engaged to a cable having a connecter, such as a USB connecter (type C), for operatively engaging a portable device encased in a protective casing. In other embodiments, the connecter may be a non-USB connecter (with or without an additional USB connecter), such as an audio jack, Ethernet connecter, or the like. In some embodiments, a second connecter may be included with the cable. In some embodiments, the cable housing defines opposing first and second retaining arms configured for establishing a snap fit engagement with the protective casing when engaging the USB connecter to a USB port of the protective case. In one aspect, the cable clip provides a means for holding the cable in place as well as sealing the cable to the protective casing and/or portable device in a secure, water-tight and operative connection. Referring to the drawings, embodiments of cable clip are illustrated and generally indicated as 100 in FIGS. 1-6 and 200 in FIGS. 7-10C.

Figure 2A:
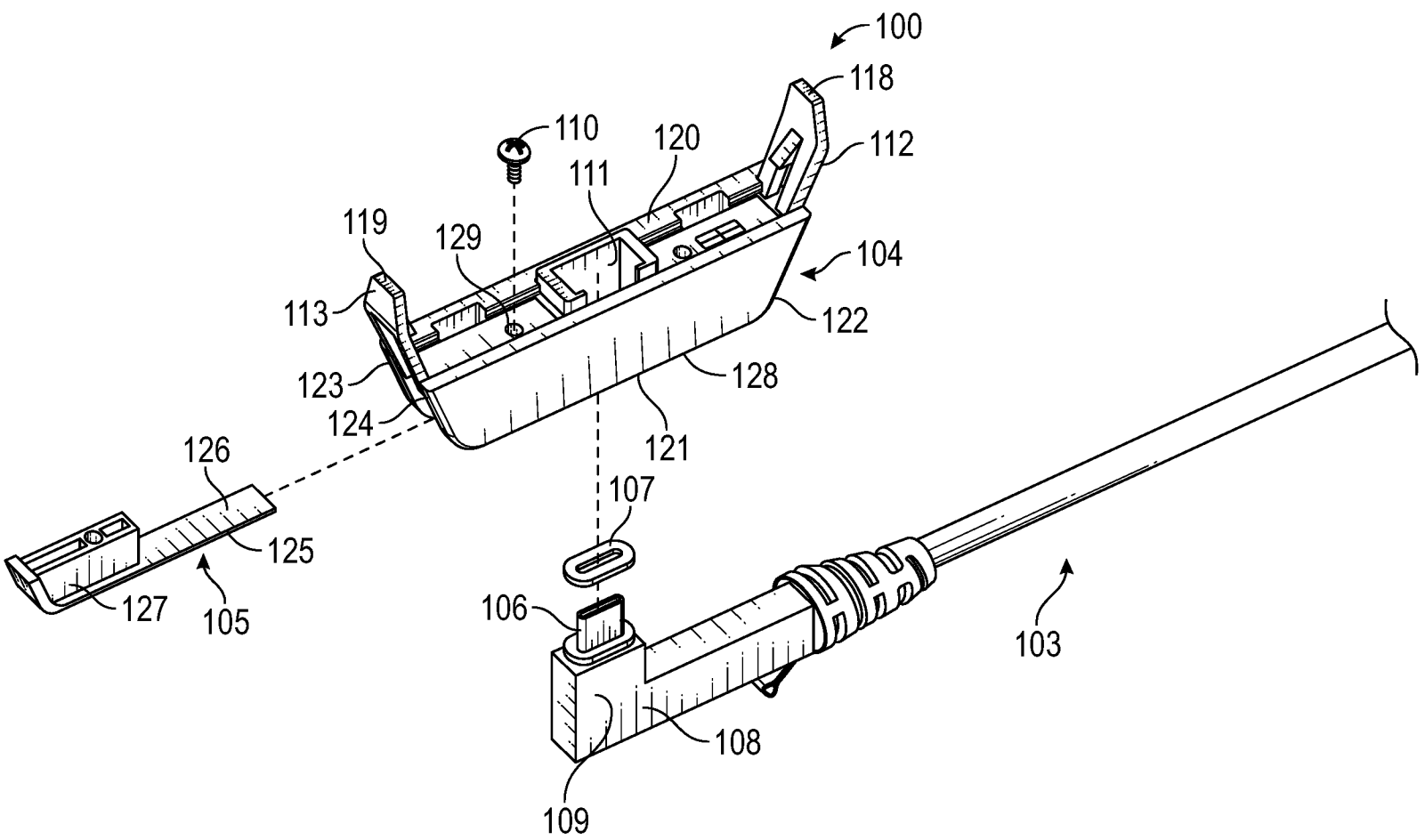
FIGS. 2A and 2B are exploded views of the cable clip and cable of FIG. 1.
Figure 2B:
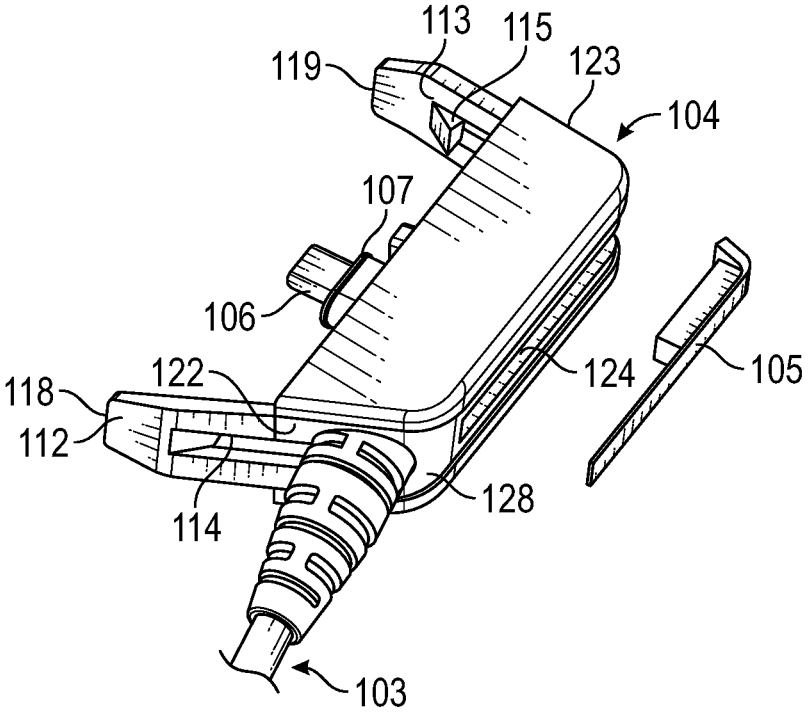
Figure 3:
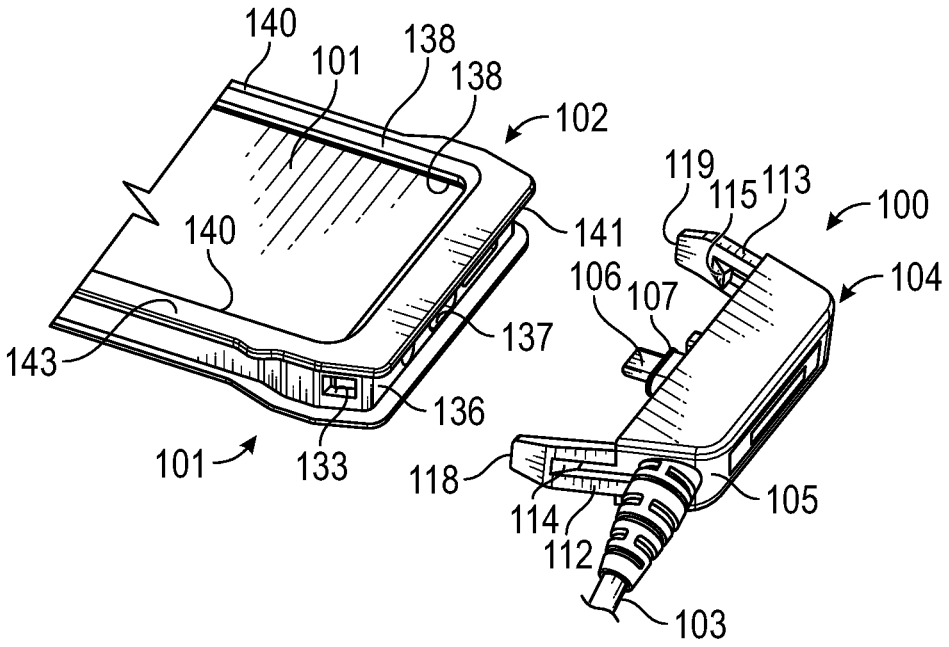
FIG. 3 is a perspective view of the cable clip in a detached state from the protective casing.
Figure 5:
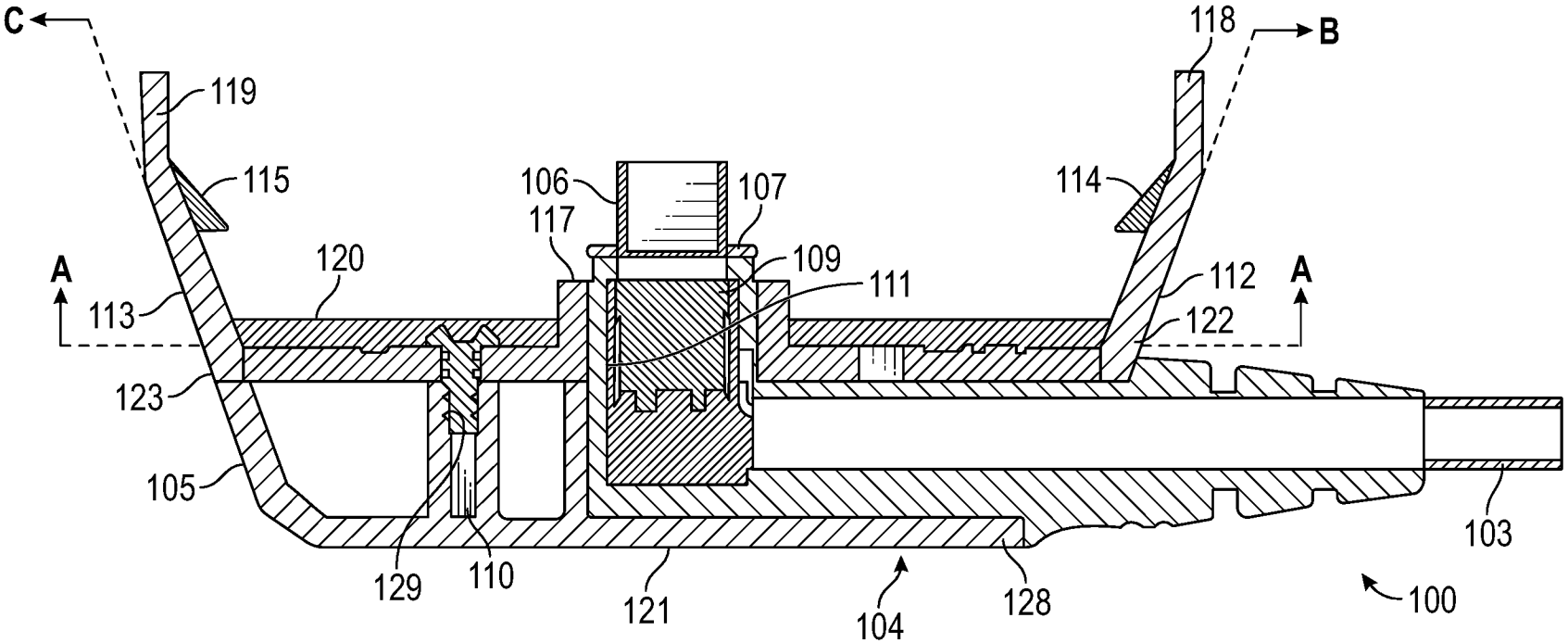
FIG. 5 is a cross-sectional view of the cable clip.
Figure 6A:
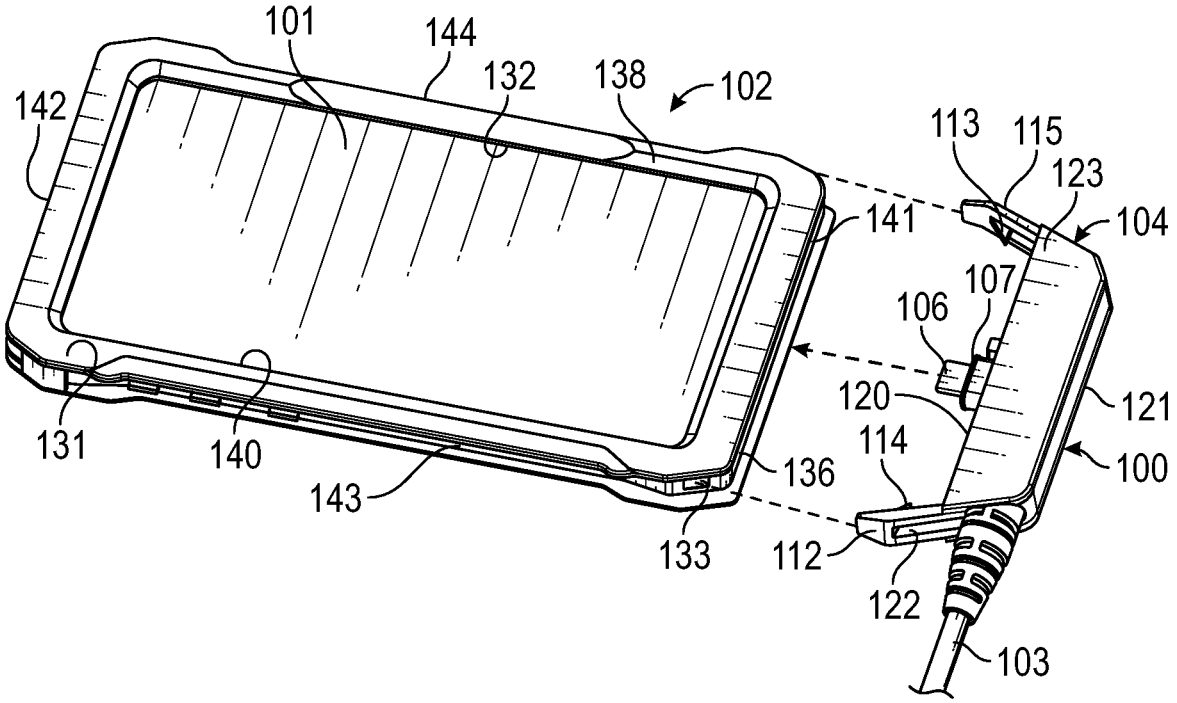
FIG. 6A is a perspective view of the cable clip prior to attachment to the protective casing.
Figure 6B:
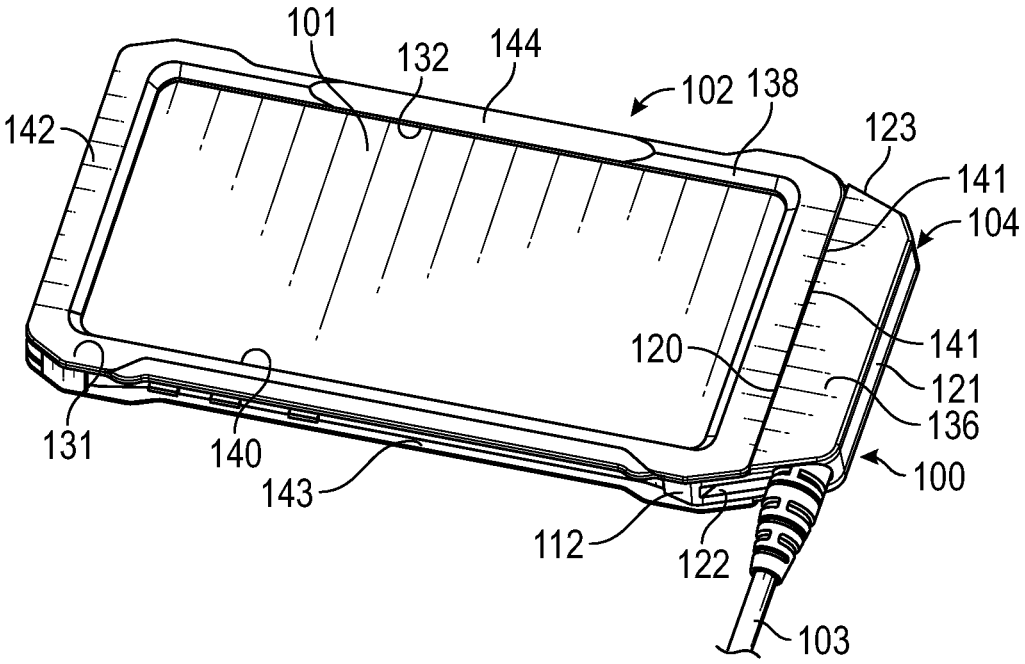
FIG. 6B is a perspective view of the cable clip after attachment to the protective casing.

As illustrated in FIGS. 1-3, the cable clip 100 may include a cable 103 connected to a clip housing 104 configured to engage a protective casing 102 for establishing operative engagement with a portable device 101 encased inside the protective casing 102. Referring to FIG. 5, in some embodiments the clip housing 104 forms a top side 120, a bottom side 121, a proximal side 122 and a distal side 123 that collectively define an interior portion 146. As shown, the clip housing 104 further defines a first retaining arm 112 forming a first distal end portion 118 and an opposing second retaining arm 113 forming a second distal end portion 119 that extend laterally outward from the proximal side 122 and distal side 123, respectively, of the clip housing 104. In some embodiments, the first retaining arm 112 includes a first tang 114 extending outwardly adjacent the first distal end portion 118 and a second tang 115 extending outwardly adjacent the second distal end portion 119 that collectively define respective engagement structures configured for engaging the protective casing 102 when coupling the cable clip 100 to the protective casing 102 as shown in FIGS. 6A and 6B. In some embodiments, the first and second tangs 114 and 115 each have a beveled configuration that extends at an obtuse angle relative to the first and second retaining arms 112 and 113, respectively. In some embodiment, the first and second tangs 114 and 115 are made of a resilient and flexible material that permits the first and second tangs 114 and 115 to flex when being engaged with the first and second engagement openings 133 and 134, respectively, of the protective casing 102 in a snap fit engagement as shall be discussed in greater detail below.

In some embodiments, a removable cap 105 is configured to engage and seal off a portion of the clip housing 104. As shown, the removable cap 105 defines an exterior portion 125, an interior portion 126 and a shoulder portion 127 collectively configured to engage and seal off a slot opening 124 formed along the peripheral edge 128 of the bottom portion 121 of clip housing 104 as shown in FIGS. 2A and 2B. As specifically shown in FIG. 2A, the clip housing 104 is configured to engage a cable 103 forming a distal end portion 108 with an extension 109 that includes a connecter 106, such as a USB cable connecter, that extends laterally at a perpendicular angle relative to the cable 103. In some embodiments, a seal 107 is engaged around a portion of the connecter 106 for establishing a water-tight seal about the connecter 106 when engaged to the protective casing 102. In some embodiments, a molded grip portion 130 is formed between the cable 103 and the extension 108 which is configured to permit easy gripping of the cable 103 by the user. In operation, the connecter 106 is configured to operatively engage the cable 103 to the portable device 101 when the portable device 101 is disposed within the protective casing 102.

As further shown in FIG. 1, in some embodiments the interior portion 146 of the clip housing 104 defines a plurality of recesses 116 aligned along the top side 120 of the clip housing 104 as well as defining an interior channel 129 formed axially through the clip housing 104 proximate the plurality of recesses 116. A retaining screw 110 is configured to be received within the interior channel 129 for securing the cap 105 to the slot 124 of the clip housing 104 during assembly. In addition, the clip housing 104 defines an axially extending mount 117 in communication with an axial channel 111 formed within the interior portion 146 of the clip housing 104 and configured to receive the extension 109 of the cable 103 such that the connecter 106 extends through the axial channel 111 of the mount 117 as shown in FIGS. 1 and 5. As noted above, a sealing element 107, such as an O-ring, is configured to engage the connecter 106 and establish a fluid tight seal between the connecter 106 and mount 117.

Figure 4:
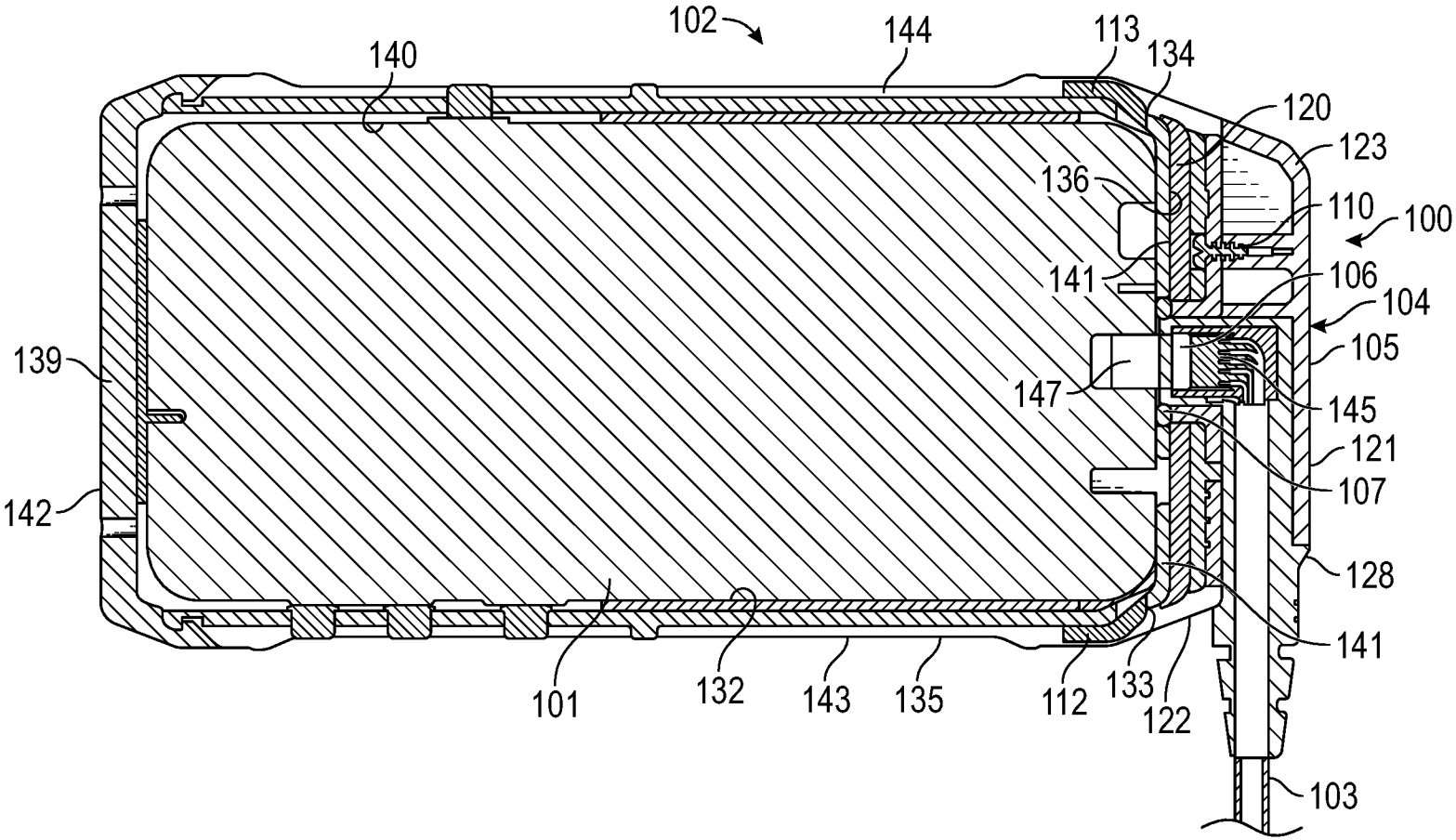
FIG. 4 is a top plan view of the cable clip operatively engaged to the protective casing encasing a portable device.

Referring to FIG. 4, in some embodiments the protective casing 102 includes a casing body 131 forming an interior chamber 132 configured to receive and encase the portable device 101 therein. As further shown, the protective casing 102 defines a proximal side 141, an opposite distal side 142, a first side 143, an opposite second side 144, a front surface 138 and a rear surface 139 that collectively define a peripheral edge 135. The protective casing 102 further defines a window 140 formed along the front surface 138 of the case body 131 that permits access to the portable device 101 encased within the interior chamber 138 of the protective casing 102. As shown in FIGS. 3, 4, 6A, and 6B, the casing body 131 forms a docking portion 136 substantially along the proximal side 141, first side 143 and opposite second side 144 of the casing body 131 which is configured to engage the clip housing 104 of the cable clip 100 to the protective casing 102 in a snap-fit engagement. In addition, the docking portion 131 defines a first engagement opening 133 configured to receive and retain in snap fit engagement the first retaining arm 112 therein and a second engagement opening 134 configured to receive and retain in snap fit engagement the second retaining arm 113 therein such that the clip housing 104 is fully engaged to the protective casing 102 and in operative engagement with the portable device 101. When both first and second retaining arms 112 and 113 are fully engaged within the first and second engagement openings 133 and 134, the connecter 106 is oriented in direct alignment with the connecter 147 of the portable device 101 through a connecter opening 137 formed along the docking portion 136 of the casing body 131 such that the lead connecters 145 of the connecter 106 are in operative connection with the connecter 147 of the portable device 101.

Referring to FIGS. 6A and 6B, in one aspect the cable clip 100 may be operatively engaged to the portable device 101 by first axially aligning the clip housing 104 with the protective casing 102 such that the connecter 106 of the cable clip 100 is axially aligned with the connecter opening 137 of the protective casing 102. As the first and second retaining arms 112 and 113 become engaged with the peripheral edge 135 of the casing body 131, the first tang 114 of the first retaining arm 112 becomes seated within the first engagement opening 133, while the second tang 115 of the second retaining arm 113 also becomes seated within the second engagement opening 134 of the protective casing 102 in a snap-fit engagement. Concurrently, the connecter 106 of the cable clip 100 becomes operatively engaged with the connecter 147 of the portable device 101 through the connecter opening 137 (FIG. 3) of the protective casing 102 to establish an operative and water-tight connection between the cable clip 100 and the portable device 101 as shown in FIGS. 4 and 6B.

Figure 7:
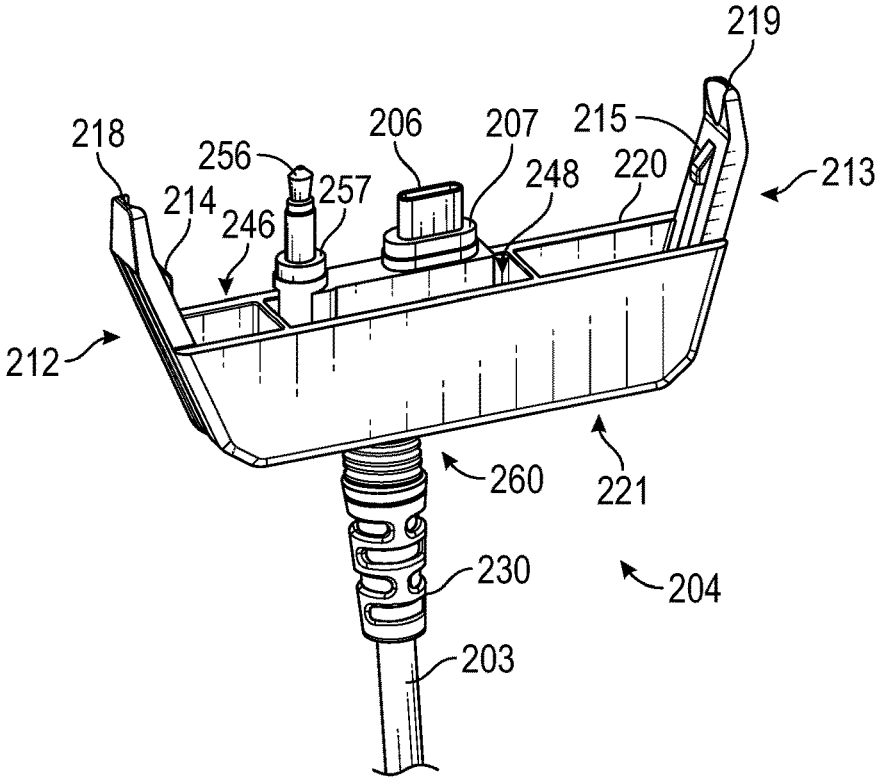
FIG. 7 is a perspective view of a second embodiment of a cable clip engaged to a cable.
Figure 8:
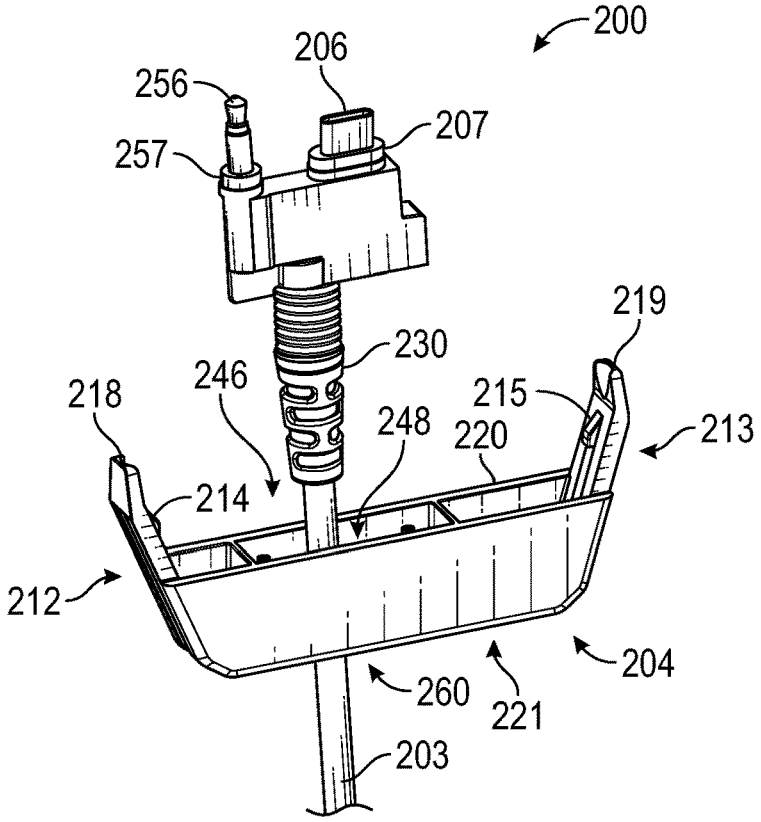
FIG. 8 is an exploded view of the cable clip and cable of FIG. 7.
Figure 9A:
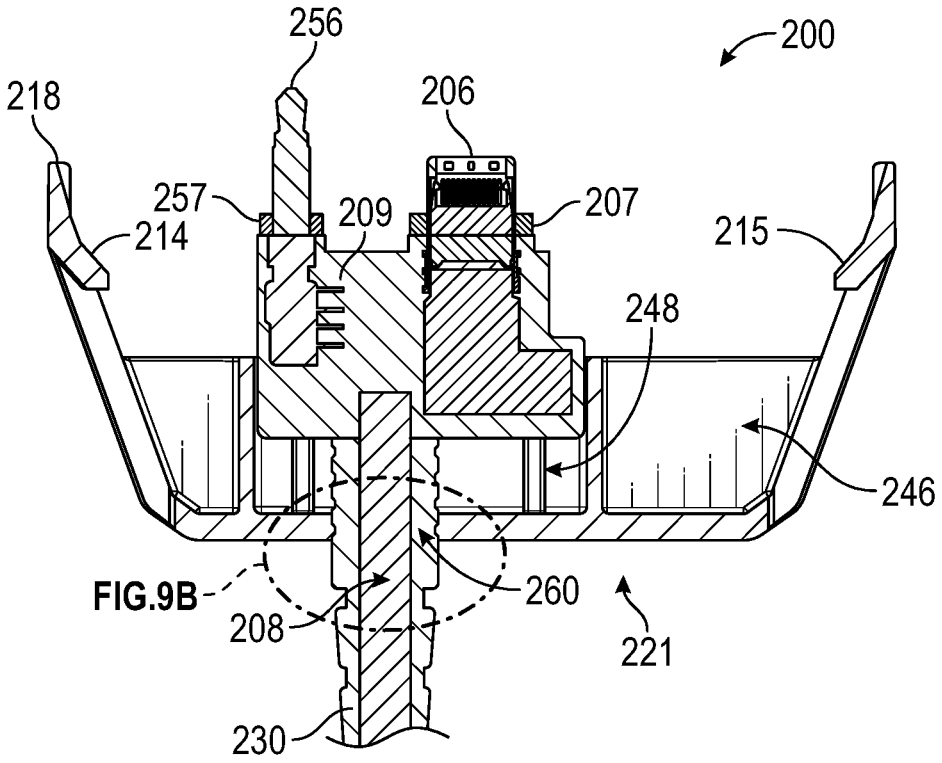
FIG. 9A is a cross-sectional view of the cable clip and cable of FIG. 7.
Figure 9B:
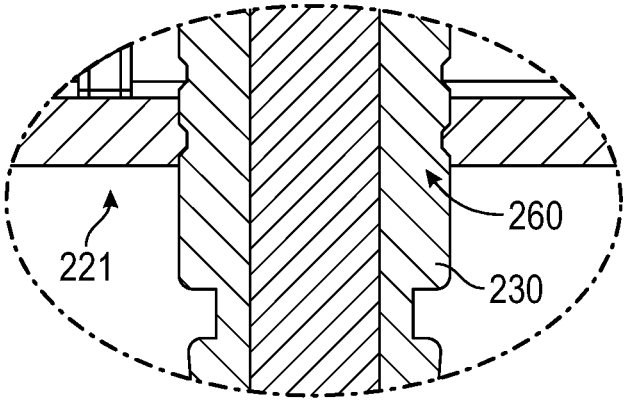
FIG. 9B is a close-up view of a cross section of the cable clip and cable of FIG. 7.
Figure 10A:
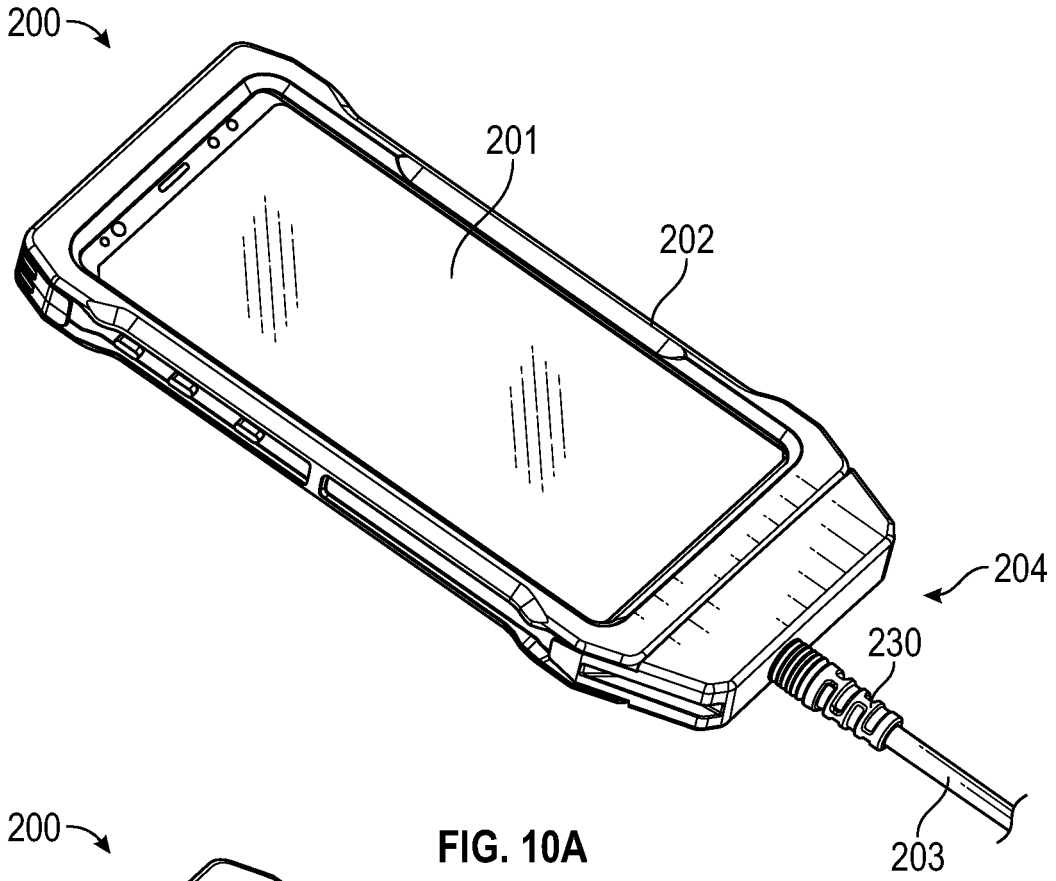
FIG. 10A is a first sequential view of the cable clip of FIG. 7 engaged with a protective casing, where the protective casing encases a portable device.
Figure 10B:
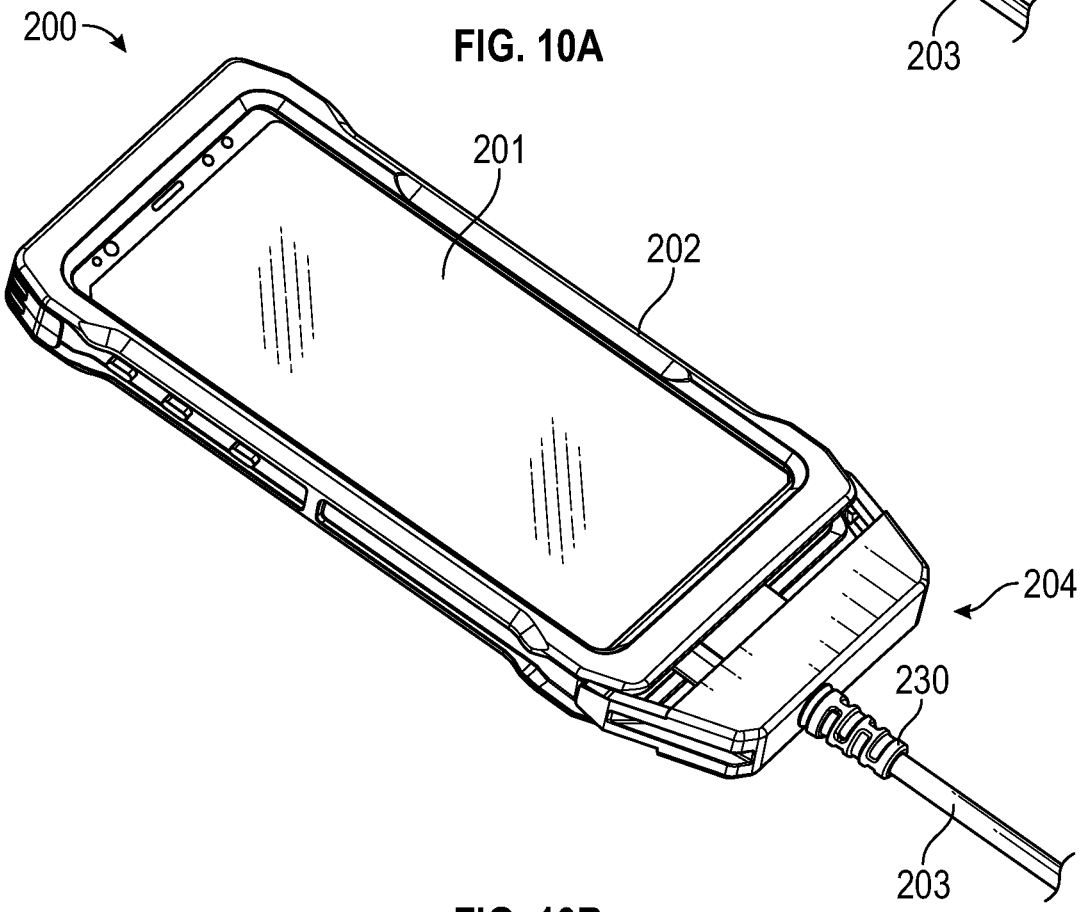
FIG. 10B is a second sequential view of the cable clip of FIG. 7 disengaged from the protective casing.
Figure 10C:
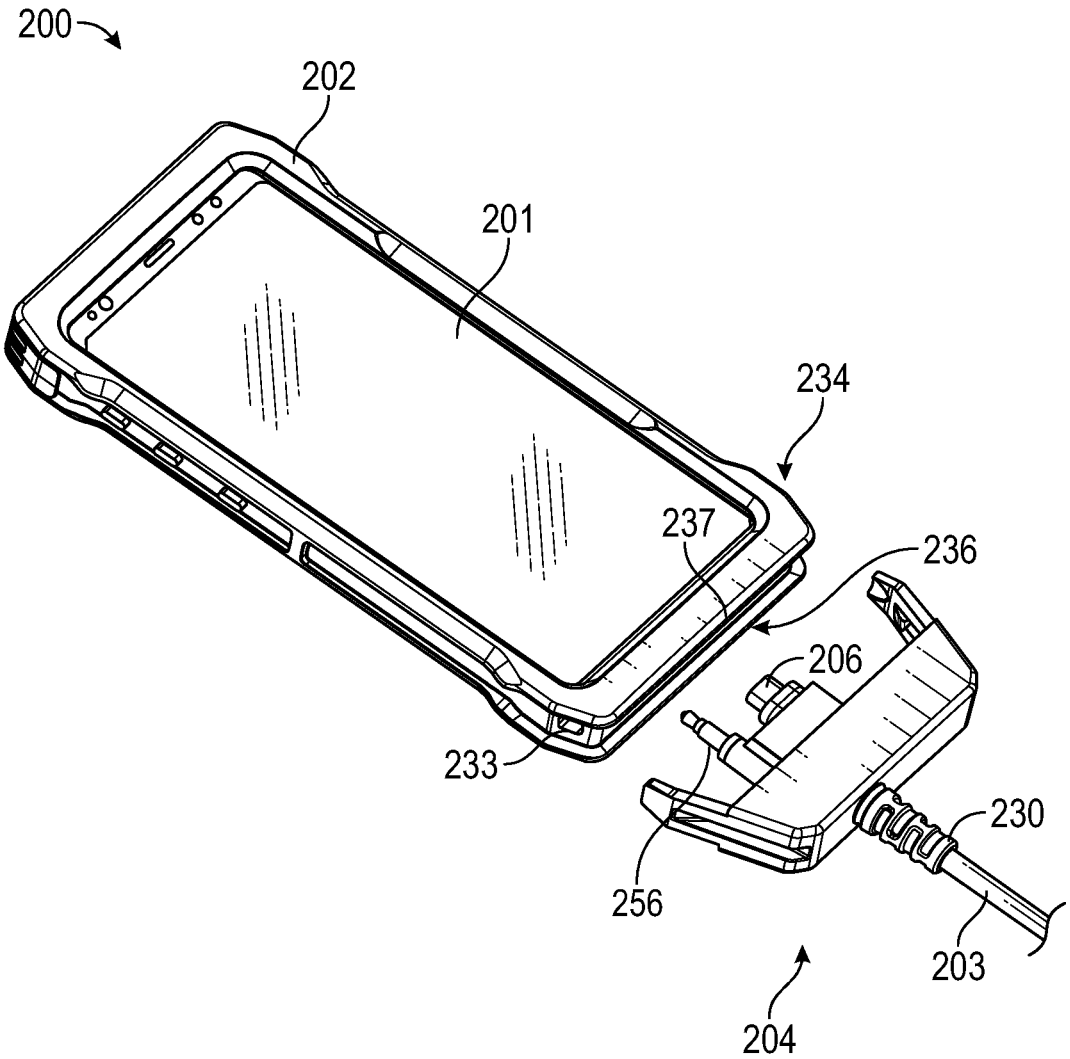
FIG. 10C is a third sequential view of the cable clip of FIG. 7 fully disengaged from the protective casing.

A second embodiment of the cable clip 200 is illustrated in FIGS. 7-10C. As illustrated in FIGS. 7-10C, the cable clip 200 may include a cable 203 connected to a clip housing 204 configured to engage a protective casing 202 for establishing operative engagement with a portable device 201 encased inside the protective casing 202. Referring to FIG. 7, in some embodiments the clip housing 204 forms a top side 220, a bottom side 221, a proximal side 222 and a distal side 223 that collectively define an interior portion 246. As shown, the clip housing 204 further defines a first retaining arm 212 forming a first distal end portion 218 and an opposing second retaining arm 213 forming a second distal end portion 219 that extend laterally outward from the proximal side 222 and distal side 223, respectively, of the clip housing 204. In some embodiments, similar to the first embodiment of the clip housing 100, the first retaining arm 212 includes a first tang 214 extending outwardly adjacent the first distal end portion 218 and a second tang 215 extending outwardly adjacent the second distal end portion 219 that collectively define respective engagement structures configured for engaging the protective casing 202 to the cable clip 200 as shown in FIGS. 10A-10C. In some embodiments, the first and second tangs 214 and 215 each have a beveled configuration that extends at an obtuse angle relative to the first and second retaining arms 212 and 213, respectively. In some embodiment, the first and second tangs 214 and 215 are made of a resilient and flexible material that permits the first and second tangs 214 and 215 to flex when being engaged with respective first and second engagement openings 233 and 234 of the protective casing 202 in a snap fit engagement.

As specifically shown in FIGS. 9A and 9B, the clip housing 204 is configured to engage a cable 203 forming a distal end portion 208 with an extension 209 that includes a first connecter 206, such as a USB cable connecter, and a second connecter 256, such as a 3.5 mm audio jack, that extend axially from the distal end portion 208 of the cable 203. Unlike the first embodiment, the cable 203 is threaded through a cable aperture 260 defined on the bottom side 221 of the clip housing 204 and held in place by a molded grip portion 230 defined at the distal end portion 208 of the cable 203, as shown in FIG. 9A. In some aspects, the interior portion 246 further comprises a pocket 248 (FIG. 9A) which is configured to receive the extension 209 of the cable 203. During assembly, as shown in FIGS. 7-9B, the cable 203 is fed through the cable aperture 260 and the extension 209 of the cable 203 is seated within the pocket 248 of the clip housing 204. It should be noted that the molded grip portion 230 of the cable 203 is tapered such that the molded grip portion 230 may be pushed into the cable aperture 260 during assembly and remain in place due to friction. In some embodiments, the cable aperture 260 may include a cable guard (not shown) or some kind of material which reduces a probability of damage to the cable 203 when bent.

In some embodiments, a first seal 206 and a second seal 257 are engaged around a portion of their respective first and second connecters 206 and 256 for establishing a water-tight seal about the first and second connecters 206 and 256 when engaged to the protective casing 202. In some embodiments, the molded grip portion 230 is formed between the cable 203 and the extension 209 which is configured to permit easy gripping of the cable 203 by the user. In operation, the first and second connecters 206 and 256 are configured to operatively engage the cable 203 to the portable device 201 when the portable device 201 is disposed within the protective casing 202.

Referring to FIGS. 10A-10C, in some embodiments the protective casing 202 includes a casing body 231 forming an interior chamber (not shown) configured to receive and encase the portable device 201 therein. The casing body 231 forms a docking portion 236 substantially along the proximal side 241, first side 243 and opposite second side 244 of the casing body 231 which is configured to engage the clip housing 204 of the cable clip 200 to the protective casing 202 in a snap-fit engagement. In addition, the docking portion 231 defines a first engagement opening 233 configured to receive and retain in snap fit engagement the first retaining arm 212 therein and a second engagement opening 234 configured to receive and retain in snap fit engagement the second retaining arm 213 therein such that the clip housing 204 is fully engaged to the protective casing 202 and in operative engagement with the portable device 201. When both first and second retaining arms 212 and 213 are fully engaged within the first and second engagement openings 233 and 234, the first and second connecters 206 and 256 are oriented in direct alignment with a first and second connecter (not shown) of the portable device 201 such that a lead connecter 245A of the first connecter 106 and a lead connecter 245B of the second connecter 256 are in operative connection with the first and second connecters (not shown) of the portable device 201. In some embodiments, the first connecter may be embodied as female USB (micro-B or C), Lightning, or any other suitable port type and the second connecter may be embodied as a female 3.5 mm audio jack or any other suitable port type.

Further referring to FIGS. 10A-10C, in one aspect the cable clip 200 may be operatively engaged to the portable device 201 by first axially aligning the clip housing 204 with the protective casing 202 such that the first connecter 206 of the cable clip 200 is axially aligned with a connecter opening 237 (FIG. 10C) of the protective casing 202. As the first and second retaining arms 212 and 213 become engaged with the first side 243 and the opposite second side 244 of the casing body 231, the first tang 214 of the first retaining arm 212 becomes seated within the first engagement opening 233, while the second tang 215 of the second retaining arm 213 also becomes seated within the second engagement opening 234 of the protective casing 202 in a snap-fit engagement. Concurrently, the first and second connecters 206 and 256 of the cable clip 200 become operatively engaged with the first and second connecters 247A and 247B of the portable device 201 through the connecter opening 237 of the protective casing 202 to establish an operative and water-tight connection between the cable clip 200 and the portable device 201 as shown in FIG. 10A.

It should be understood from the foregoing that, while particular embodiments have been illustrated and described, various modifications can be made thereto without departing from the spirit and scope of the invention as will be apparent to those skilled in the art. Such changes and modifications are within the scope and teachings of this invention as defined in the claims appended hereto.

What is claimed is:

1. A cable clip comprising: a clip housing defining a top side, an opposite bottom side, a first side, and an opposite second side that collectively form an interior portion; a first retaining arm extending from the first side of the clip housing, wherein the first retaining arm includes a first tang extending inward from the first retaining arm; a second retaining arm extending from the second side of the clip housing, wherein the second retaining arm includes a second tang extending inward from the second retaining arm; and a cable having a distal end portion forming an extension configured to extend through the interior portion of the clip housing, wherein the cable includes one or more connecters configured to extend from the clip housing when the cable is coupled to the clip housing, wherein the cable and the extension are removable from the clip housing, wherein the clip housing defines a slot along a peripheral edge thereof in communication with the interior portion; and a removable cap configured to engage the slot of the clip housing.

2. The cable clip of claim 1, wherein the first and second tangs extend inwardly in opposite relation to each other.

3. The cable clip of claim 1, wherein the first and second tangs each define a beveled configuration.

4. The cable clip of claim 1, further comprising:

a mount in communication with an axial channel, the mount extending from the interior portion of the clip housing and configured to receive the one or more connecters through the axial channel.

5. The cable clip of claim 1, further comprising:

a sealing element engaged to each of the one or more connecters for establishing a water-tight seal around each connecter.

6. The cable clip of claim 1, wherein the first retaining arm and second retaining arm each define a distal end portion having an angled configuration in opposite relation to each other.

7. The cable clip of claim 1, wherein the slot is configured to receive the extension and the distal end of the cable.

8. The cable clip of claim 1, wherein one of the one or more connecters comprises a USB connecter.

9. The cable clip of claim 1, wherein the cable further comprises:

a second connecter configured to extend from the clip housing.

10. The cable clip of claim 1, wherein the clip housing further comprises:

a cable aperture defined along the bottom side of the clip housing.

11. A cable clip and casing arrangement comprising:

a cable clip comprising:

a clip housing defining a top side, opposite bottom side, first side, and an opposite second side that collectively form an interior portion;

a first retaining arm extending from the first side of the clip housing, wherein the first retaining arm includes a first tang extending inward from the first retaining arm;

a second retaining arm extending from the second side of the clip housing, wherein the second retaining arm includes a second tang extending inward from the second retaining arm; and a cable having a distal end portion forming an extension configured to extend through the interior portion of the clip housing, wherein the cable includes one or more connecters configured to extend from the clip housing when the cable is coupled to the clip housing, wherein the cable and the extension are removable from the clip housing, wherein the clip housing defines a slot along a peripheral edge thereof in communication with the interior portion;

a removable cap configured to engage the slot of the clip housing; and a casing for encasing a portable device comprising:

a casing body comprising:

a distal side, an opposite proximal side, a first side, and an opposite second side;

a docking portion configured to engage the clip housing;

a first engagement opening defined along the first side and a second engagement opening defined along the opposite second side, wherein the first engagement opening is configured to engage the first tang of the first retaining arm and the second engagement opening is configured to engage the second tang of the second retaining arm.

12. The cable clip and casing arrangement of claim 11, wherein the first and second tangs of the cable clip extend inwardly and are configured to engage each of the plurality of engagement openings of the casing.

13. The cable clip and casing arrangement of claim 11, wherein the one or more connecters of the cable are configured for engagement with one or more connecters of the portable device.

14. The cable clip and casing arrangement of claim 13, wherein the casing body further comprises:

one or more connector openings formed on the proximal side of the casing body such that each of the one or more connecters of the cable can be disposed through the one or more connector openings formed on the proximal side of the casing body and become engaged with the one or more connecters of the portable device.

15. A cable clip, comprising:

a clip housing defining a top side, an opposite bottom side, a first side, and an opposite second side that collectively form an interior portion, wherein the opposite bottom side defines a cable aperture;

a first retaining arm extending from the first side of the clip housing, wherein the first retaining arm includes a first tang extending inward from the first retaining arm;

a second retaining arm extending from the second side of the clip housing, wherein the second retaining arm includes a second tang extending inward from the second retaining arm; and a cable having a distal end portion forming an extension configured to extend through the interior portion and the cable aperture of the clip housing, wherein the cable includes a first connecter and a second connecter configured to extend from the clip housing when the cable is coupled to the clip housing, wherein the cable and the extension are removable from the clip housing, wherein the clip housing defines a slot along a peripheral edge thereof in communication with the interior portion; and a removable cap configured to engage the slot of the clip housing.

16. The cable clip of claim 15, wherein the first connecter comprises a USB connecter and wherein the second connecter comprises an audio connecter.

17. The cable clip of claim 15, wherein the interior portion of the clip housing further comprises:

a pocket formed within the interior portion of the clip housing such that the extension of the cable is configured to be disposed within the pocket formed within the interior portion of the clip housing.

18. The cable clip of claim 15, wherein the cable extends axially from the bottom side of the clip housing through the cable aperture defined by the bottom side of the clip housing.

* * * * *